United States Patent [19]

Shida et al.

[11] 4,271,496

[45] Jun. 2, 1981

[54] ELECTRONIC WATCH

[75] Inventors: Masaharu Shida; Akira Torisawa; Makoto Ueda; Masaaki Mandai; Katsuhiko Sato; Kazuhiro Asano, all of Tokyo, Japan

[73] Assignee: Kabushiki Kaisha Daini Seikosha, Tokyo, Japan

[21] Appl. No.: 898,396

[22] Filed: Apr. 20, 1978

[30] Foreign Application Priority Data

Apr. 23, 1977 [JP] Japan ..... 52-47095

[51] Int. Cl.[3] ..... G04B 19/04; G04C 3/00

[52] U.S. Cl. ..... 368/80; 368/217

[58] Field of Search ..... 58/23 R, 23 A, 23 BA, 58/23 D, 152 H; 318/696, 685; 340/373, 636, 663, 672; 368/75-87, 217-219

[56] References Cited

U.S. PATENT DOCUMENTS 3,830,052 8/1974 Daniels et al. ..... 58/23 BA 3,855,781 12/1974 Chihara et al. ..... 58/4 A 4,028,880 6/1977 Ueda ..... 340/636

4,032,827 6/1977 Dobratz ..... 58/53 D

*Primary Examiner*—Vit W. Miska

*Attorney, Agent, or Firm*—Robert E. Burns; Emmanuel J. Lobato; Bruce L. Adams

[57] ABSTRACT

An electronic timepiece including a stepping motor and a time-indicating hand moved in a stepwise manner by the stepping motor for indicating time. During normal operation the time-indicating hand moves at a normal periodic rate. When operating conditions such as a low battery cause the stepping motor to not rotate, correcting pulses are applied to the stepping motor to supply additional energy to it to cause it to rotate. Additionally, the correcting pulses cause the rotor, and the time-indicating hand to rotate at a rate different from the normal periodic rate to alert the timepiece user that some condition exists tending to cause non-rotation of the stepping motor.

5 Claims, 13 Drawing Figures

FIG. 7
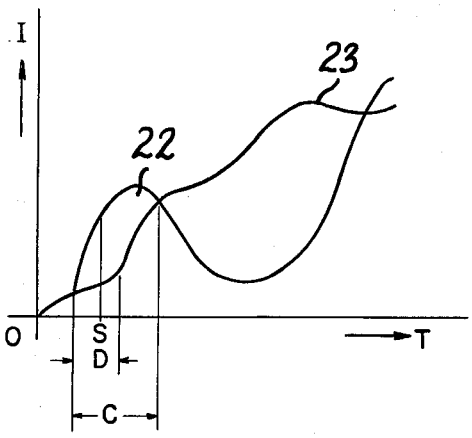
FIG. 8
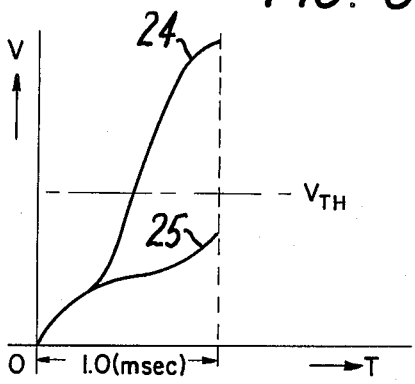
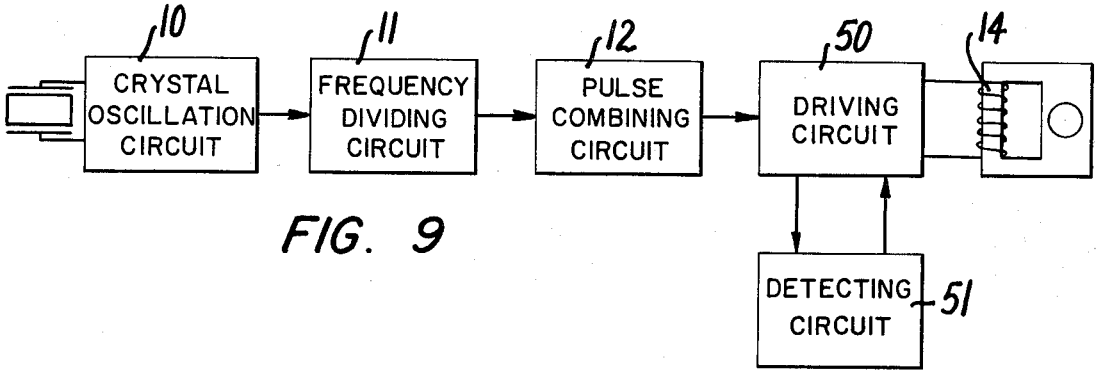
FIG. 9
FIG. 10
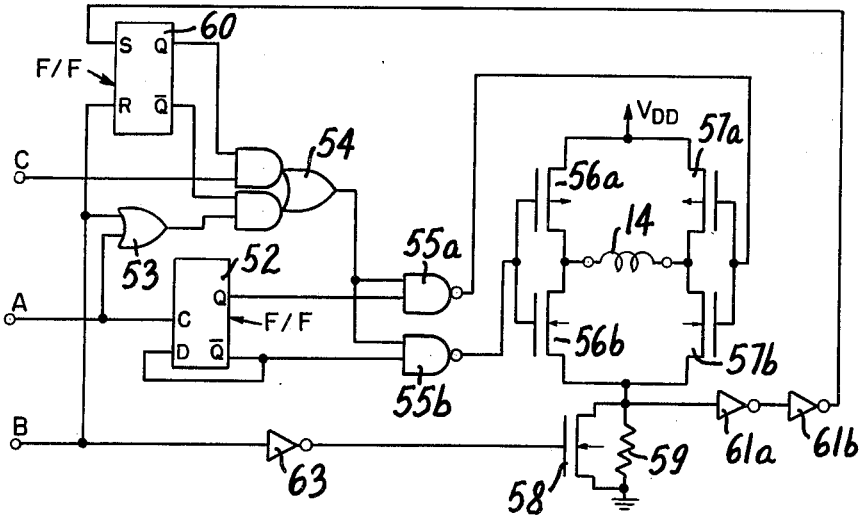

ELECTRONIC WATCH

BACKGROUND OF THE INVENTION

The present invention relates to an improvement of an electronic watch, and more particularly to circuitry for displaying an operating condition of a stepping motor of the electronic watch including detecting means for detecting the rotation of the stepping motor for the purpose of reducing power consumption of the stepping motor.

BRIEF DESCRIPTION OF THE DRAWINGS

FIG. 7 shows the current waveforms of both the normal rotating condition and the non-rotating condition of the stepping motor, FIG. 8 shows each voltage waveform developed across the detection resistor of a rotation detection circuit according to the present invention, FIG. 9 shows a circuit according to the present invention, FIGS. 10 and 11 show respectively the circuit and a signal waveform timing chart thereof according to the present invention.

DESCRIPTION OF THE PREFERRED EMBODIMENTS

An embodiment of the present invention will now be described with respect to an analog type electronic watch in conjunction with the accompanying drawings.

Figure 1:
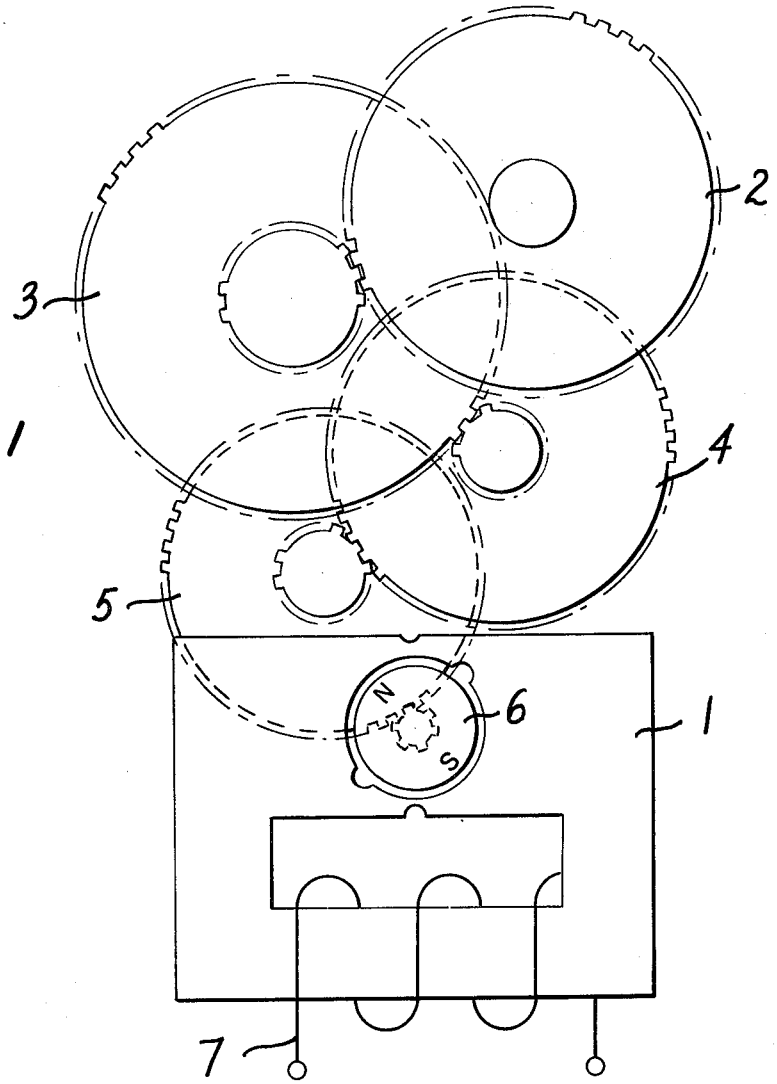
FIG. 1 shows an example of a displaying mechanism of an analog type electronic watch.

The display mechanism of the conventional crystal watch of the analog type now in use is constructed as shown in FIG. 1. The output of a motor consisting of a stator 1, a coil 7 and a rotor 6 is transmitted to different wheels 2, 3, 4 and 5, and a second pointer, a minute pointer, an hour pointer as well as a calender are driven by the wheels together with other wheels not shown.

Figure 2:
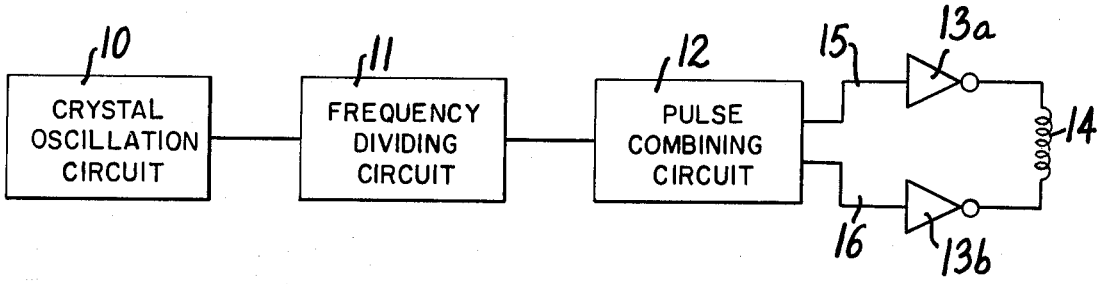
FIG. 2 shows a circuit construction of a crystal oscillator electronic watch.
Figure 3:
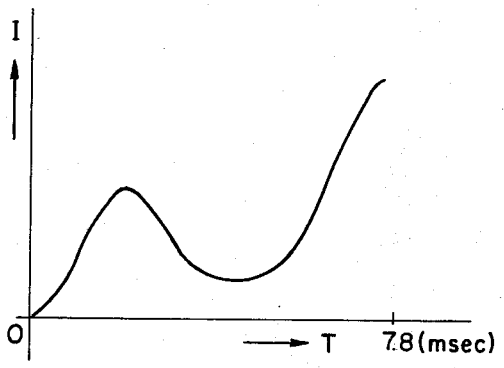
FIG. 3 shows a current waveform of the conventional stepping motor.

FIG. 2 shows a circuit construction of a conventional electronic watch. A signal of about 32 KHz from an oscillating circuit 10 is converted into a second signal having a period of one second by a frequency dividing circuit 11. The second signal is further converted into the signal having either a 1.8 m sec or 2 sec. period by a pulse combining circuit 12. Input terminals 15, 16 of drive inverters 13*a*, 13*b* each receive a signal having the same pulse period and width but out of phase by one second, so that alternate polarity pulses alternating every one second are applied to a coil 14, and the rotor 6 magnetized with two poles begins to rotate in one direction. The coil current waveform in this case is shown in FIG. 3.

The drive pulse width in the prior art electronic watch, for example, 7.8 m sec in the above mentioned embodiment, is designed in such a way that the factors such as coil resistance, number of coil turns, size of the stepping motor are suitably selected so as to drive the stepping motor in a stable condition even when the load of the wheels is great, as when they are placed in a magnetic field, the internal resistance of a battery has been greatly increased at a very low temperature, or the battery voltage has been lowered because of exhaustion of the battery. In addition, when a large torque is not necessary, this causes excess consumption of the battery energy.

To overcome such defects described above, a method for driving a stepping motor has been proposed recently wherein a detecting means for detecting the operating condition of the stepping motor is provided so as to change the drive power (generally, a driving pulse width) continuously or stepwise in minimum power.

The object of the present invention is to provide an electronic watch having a stepping motor rotation detecting means so as to reduce power consumption. When the stepping motor can no longer rotate unless more than a predetermined power level (pulse width) is applied, a warning is provided to a user of the watch by changing the operating condition of the watch, for instance, by changing from a normal one second pointer movement to a two seconds pointer movement every two seconds. This condition warns the watch user that the watch motor is not operating normally. Such abnormal operation may occur because the watch battery is near the end of its lifetime, or because the watch is exposed to a magnetic field or a low temperature.

FIG. 9 shows schematically the construction of the embodiment according to the present invention. The output of an oscillating circuit 10 is applied to a frequency dividing circuit 11 where it is divided. The output of the dividing circuit 11 is applied to a pulse combining circuit 12 when it is combined to produce a pulse necessary for the operation of a drive circuit 50 and the output from the combining circuit 12 is applied to the drive circut 50. The output from the drive circuit 50 is connected to a coil 14 of the stepping motor. Also, another output of the driving circuit is applied to a detection circuit 51 and the output of the detection circuit 51 is applied to the driving circuit 50 as a control signal.

Figure 11:
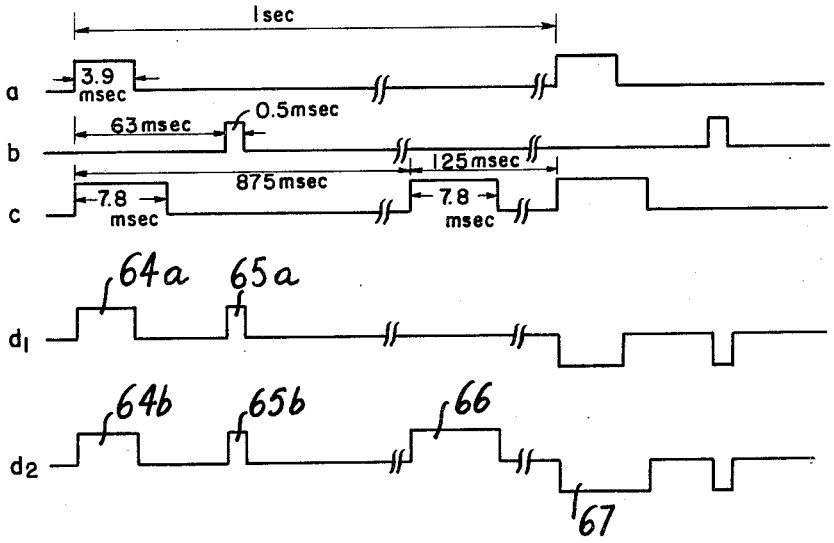

FIGS. 10 and 11 show the construction of the driving and detection circuits according to the present invention and a timing chart of signal waveforms developed during operation of the driving and detection circuits.

The drive circuit 51 consists of a driving portion comprising a D-type flip-flop 52, a OR gate 53, NAND gates 55*a*, 55*b* and drive inverters 56*a*, 56*b* and 57*a*, 57*b*, and a control portion comprising a RS-type flip-flop 60 and a selection gate 54. The detection circuit 51 comprises a resistor 59, detection inverters 61*a*, 61*b*, a N-type MOS FET 58 and an inverter 63. The input terminal A is connected to the clock terminal of the D-type flip-flop and the first input of the OR gate 53, respectively. The input terminal B is connected to the reset terminal of the RS-type flip-flop 60, the second input of the OR gate 53 and the input of the inverter 63. The output of the OR gate 53 is connected to the second input of the selection gate 54 and the input terminal C is connected to the first input of the selection gate 54. The output terminals Q and $\overline{Q}$ of the RS flip-flop 60 are connected to the selection inputs of the selection gate 54. The output of the selection gate 54 is connected to the first inputs of NAND gates 55*a* and 55*b*, respectively. Furthermore, the outputs Q, Q of D flip-flop 52 are connected respectively to the second inputs of NAND gates 55*a* and 55*b*. The outputs of the NAND gates 55*a*, 55*b* are connected to the input terminals of transistors 57*a*, 57*b* and 56*a*, 56*b* which together comprise a pair of inverters. The outputs of the two inverters are connected to both terminals of the coil 14. The earth or ground terminals of the inverters, i.e. the source terminals of N type MOS FET 56*b* and 57*b* are connected to one side of the resistor 59, the drain of a N type MOS FET 58 and the input terminal of a detecting inverter 61*a*. The output of the inverter 63 is connected to the gate of N type MOS FET 58. The other side of the resistor 59 and the source of N type MOS FET 58 are grounded. The output of the detecting inverter 61*a* is connected to the input terminal of the inverter 61*b*. The output terminal of the inverter 61*b* is connected to the set terminal of the RS flip-flop 60.

In operation, the outputs Q and $\overline{Q}$ of the D type flip-flop 52 change signal level every time one pulse is applied to the input terminal A, so that the output of the selection gate 54 is applied alternatively to both terminals of the coil 14 and this causes in turn an alternating current through the coil, thereby rotating the stepping motor step-by-step. During the normal driving, N type MOS FET 58 is conductive and the resistor 59 is short-circuited.

Before entering into a detailed explanation of the operation of the circuit, the operating principle of the rotation detecting circuit employed in the embodiment of the invention will now be briefly explained.

The rotation of the stepping motor used in the electronic watch according to the present invention is based on the following principle.

Figure 4:
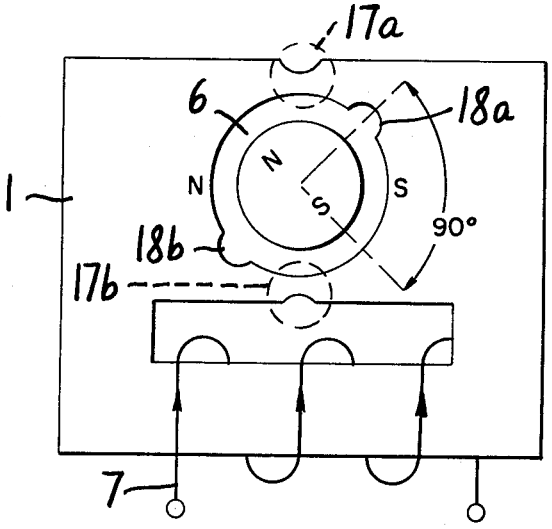
FIGS. 4 through 6 show operations of the stepping motor, respectively.

Referring to FIG. 4, reference numeral 1 represents a stator constructed as an integral member or body in which saturable magnetic paths 17 are constructed. They are magnetically coupled to a magnet core portion wound by coil 7. To this stator, there is provided notches 18*a*, 18*b* so as to determine the rotating direction of the rotor 6 which is magnetized in the radial direction with two poles. FIG. 4 shows a condition just after current is applied to the coil 7. However, when the current is not applied to the coil, the rotor 6 is stationed at the position where the angle between the notches 18 and the magnetic pole of the rotor is approximately 90°. In this condition, when the current flows in the direction of the arrow through the coil 7, the magnetic poles are generated in the stator as shown in FIG. 4 and the rotor 6 starts rotating clockwise due to repulsion between the rotor poles and the stator poles. When the current flowing through the coil 7 is interrupted, the rotor 6 comes to a standstill at the opposite position relative to that shown in FIG. 4. After this, by flowing the current in the opposit direction through the coil 7, the rotor 6 continuous to rotate clockwise.

Since the stepping motor used in the electronic wrist watch in this embodiment is constructed with the stator as an integral body having the saturable portion 17, the waveform of the current which flows through the coil 7 exhibits the characteristics with a gradual rising as shown in FIG. 3. This is because the magnetic resistance of the magnetic circuit viewed from the coil 7 is very low before the saturable portion 17 of the stator 1 saturates and as a result, the time constant $\tau$ of the series circuit of resistor r and coil 7 becomes large. This can be expressed by the following equation.

$$\tau = L/R,\ L \simeq N^2/R_m$$

$$\text{Therefore, } \tau = N^2/(R \times R_m)$$

where,

L: inductance of the coil 7

N: number of turns of the coil 7

$R_m$: magnetic resistance

When the saturable portion 17 of the stator 1 saturates, the permeability of the portion saturated is the same as that of the air, so that the magnetic resistance $R_m$ increases and the time constant $\tau$ of the circuit becomes small as shown in FIG. 3. As a result, the current amplitude suddenly rises. The detection of the rotating condition of the rotor 6 used in the electronic watch according to the present invention results in the difference of the time constant of the series circuit of the resistor and the coil. Next, the reason for the difference of the time constant will be explained in conjunction with the drawings.

Figure 5:
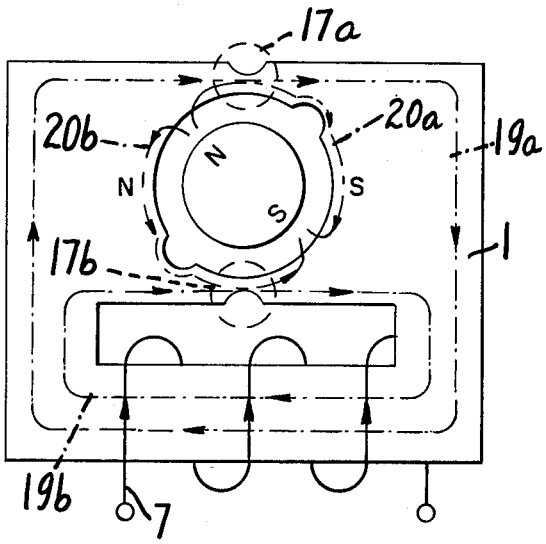

FIG. 5 shows a condition of the magnetic flux just after current is applied to the coil 7, and the poles of the rotor 6 are placed in a position which enables rotation of the rotor 6. The magnetic flux lines 20*a*, 2*b* illustrated in FIG. 5 show magnetic flux produced from the rotor 6. In practice, although there exists a flux crossing the coil 7, this is omitted from the drawing. The magnetic flux lines 20*a*, 20*b* are directed to the directions of the arrows shown in FIG. 5 at the saturable portions 17*a* and 17*b* of stator 1. The saturable portion 17, in most cases, has not yet saturated. In this condition, the current flows through the coil 7 in the direction of the arrow so as to rotate the rotor clockwise. The magnetic fluxes 19*a* and 19*b* produced by the coil 7 are strengthened by the fluxes 20*a*, 20*b* produced by the rotor 6 at the saturable portions 17*a* and 17*b*, so that the saturable portion 17 of the stator 1 will promptly saturate. Afterwards, the magnetic flux which has a sufficient strength for rotating the rotor 6 is produced in the rotor 6, but this is omitted from the drawing in FIG. 5. The current waveform flowing through the coil at this time is shown as numeral 22 in FIG. 7.

Figure 6:
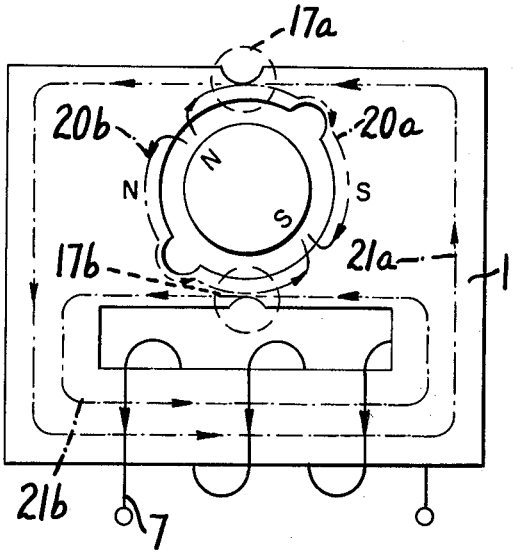

FIG. 6 shows a condition of the flux for the case where current has flowed through the coil 7 when the rotor 6 could not rotate for some reason and has returned to the original position. In general, for the purpose of rotating the rotor 6, the current must flow through the coil in a direction opposite to the arrow, namely, in the same direction of the current shown in FIG. 5. However, since the alternating current which changes its direction every one revolution is applied to the coil 7, the condition illustrated in FIG. 6 will occur unless the rotor 6 can rotate. In this case, since the rotor 6 could not be rotated, the direction of the flux produced by the rotor 6 is the same as that shown in FIG. 5. Since the current flows in the opposite direction as that shown in FIG. 5, the direction of the magnetic fluxes have directions as shown by 21*a* and 21*b*. At the saturable portions 17*a* and 17*b* of the stator 1, the magnetic fluxes produced by the rotor 6 and the coil 7 tend to cancel each other. To saturate the saturable portions of the stator 1, a much longer time is necessary than for the condition illustrated in FIG. 5. This is shown by waveform 23 in FIG. 7.

The detecting operation of the circuit according to the invention will be explained with reference to FIGS. 10 and 11. To the terminals A, B and C, there are provided a normal drive pulse a, a detecting pulse b and a correcting pulse c as shown in FIG. 11, respectively, and these pulse signals are combined and selected by the OR gate 53 and the selection gate 54. These signals are applied alternatively to the drive inverters 56a, 56b and 57a, 57b through the flip-flop 52 and NAND gates 55a and 55b, so that the voltage shape of $d_1$ as shown in FIG. 11 is applied across the coil 14. Assuming now that the rotor rotates one step in the normal condition in response to the drive pulse 64a, the rotor magnetic poles have a condition as shown in FIG. 6 when the detecting pulse 65a is applied to the motor coil 14.

Accordingly, the current waveform of the current flowing through the coil at this time will be like the waveform in FIG. 7 identified by numeral 23 having a slow rise time. At this time, since the field effect transistor 58 is in the off condition and the resistor 59 is connected in series to the coil 14, the current waveform becomes different from that shown in FIG. 7 apparently. However, so long as the rising portion is concerned, it will have a similar shape. In this case, the terminal voltage waveform at the resistor 59 becomes like that shown by numeral 25 in FIG. 8, so that the voltage can not rise up to the threshold value $V_{th}$ of the inverter 61a within the duration of the detecting pulse, thus no detection signal is produced.

If, for some reason, the rotor could not be rotated by one step by the application of the driving pulse 64, when the detecting pulse 65b is applied the relationship of the rotor and stator poles is as shown in FIG. 5. The current waveform resulting from the detection pulse will thus exhibit a fast rise time. Accordingly, the waveform of the terminal voltage of the resistor 59 reaches the threshold of the inverter 61a as shown in FIG. 8 by reference numeral 24, thus producing a detecting signal. In this way, the detection of the rotation or non-rotation of the rotor can be carried out. The value of the resistor 59 can be chosen with a considerably wide range if only the detecting pulse width is decided. In FIG. 8, the detecting pulse width is chosen as 1 msec. However, in the present embodiment a high value of the resistor 59 is chosen with the detection pulse width of 0.5 msec. With this construction, the power consumption required for the detection can be maintained low.

Now the operation of the embodiment will be described in detail.

In the embodiment hereinafter explained, the signal waveform which is continuously applied to the input terminal is easily obtained by a simple gate, so that its wave-shaping circuitry has been omitted here. The flip-flop 60 is, during the operation, in the reset condition so that the selection gate 54 selects the incoming signals A and B through the OR gate.

Assuming now that the rotor could not be rotated by the driving pulse 64b and the non-rotated condition thereof is detected by the detecting pulse 65b, the detecting signal at this time causes the flip-flop 60 to be inverted into a set condition. As a result, the selection gate 54 selects the warning or correcting drive pulse C and the voltage as shown in FIG. 11 as numeral $d_2$ is applied across the coil 14. At this time, the pointer movement operation is not being carried out by the drive pulse 64b, so that the pointer stops for two seconds (more exactly, for 1.875 seconds). A warning of this condition in which every two-seconds a pointer movement operation is being carried out is given to the user of this watch.

The flip-flop 60 is set by the detecting signal for being put in a ready condition for the operation occuring about one second later.

With this construction, when the abnormal conditions such as these occur in which the wheel loads of the electronic watch have been increased, the watch has been exposed to a magnetic field, or the battery voltage has dropped, warning is provided to the user.

Figure 12:
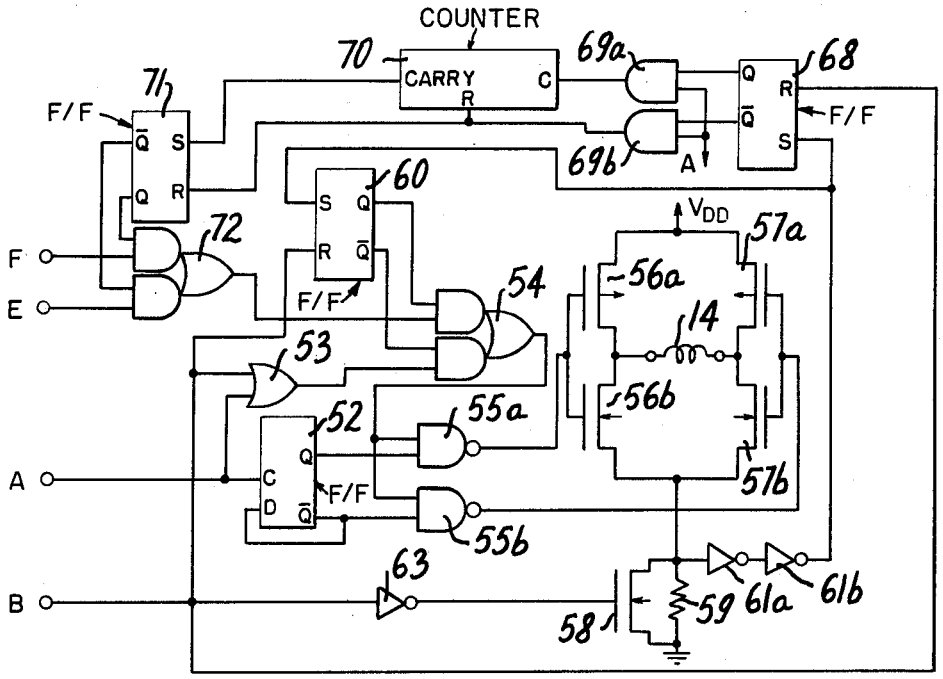
FIGS. 12 and 13 show respectively another circuit according to the present invention and its signal waveform timing chart.
Figure 13:
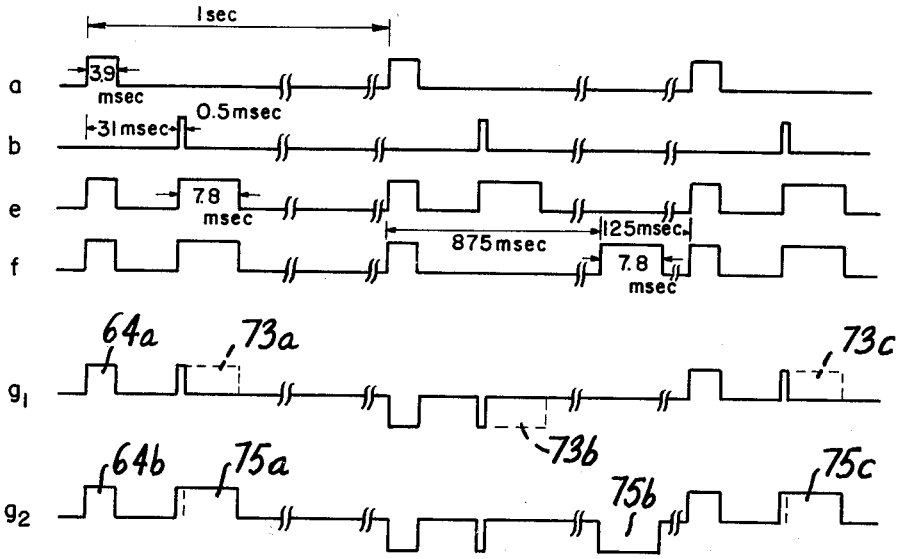

FIGS. 12, 13 show another embodiment according to the present invention and its timing chart of signal waveforms developed during operation of this embodiment. In this embodiment, there is provided a counter 70 for counting the number of times of correction driving wherein a distinction is made between the driving due to the increase of the wheel load so as to intermittently carry out the correction driving, and correction during in other cases (such as entering an external magnetic field, increasing of the internal resistance of the battery, or dropping of the battery voltage), by changing the pointer movement operation only when the correction driving is continuously performed.

The principle for the detection of rotation of the stepping motor is the same as the one described in the foregoing.

The additional elements included in the embodiment illustrated in FIG. 12 are as follows.

The set terminal of a RS flip-flop 68 is connected to the output of the inverter 61b, the reset terminal is connected to the input terminal B, and the outputs Q and $\overline{Q}$ are connected to the first inputs of the AND gates 69a and 69b, respectively. The second inputs of the AND gates 69a and 69b are connected to the input terminal A.

The output of the AND gate 69a is connected to the clock terminal of the counter 70, and the output of the AND gate 69b is connected to the reset terminal of the sixteen advancing counter 70 and to the reset input of the RS flip-flop 71. The carry terminal of the sixteen advancing counter 70 is connected to the set terminal of the RS type flip-flop 71. The first input of the selection gate 72 is connected to the input terminal F, the second input is connected to the input terminal E and the selection AND gate input terminals are connected to the output terminals Q, $\overline{Q}$ of the RS flip-flop 71, respectively. Normally, the output of the flip-flop 71 produces a binary "0" signal. In this condition, the selection gate 72 selects the signal E and when the correction driving is to be performed, it can take place within a very short time without or almost without being noticed by the watch user by utilizing a correction signal e. The voltage shape across the coil 14 at this time is shown in FIG. 13 by numeral $g_1$.

Next, the operation of the circuit will be explained centering around the sixteen advancing counter 70. The flip-flop 68 is reset at the same time as the rise of the detecting pulse signal b and is set when the detection signal appears at the inverter 61b. Accordingly, the signal a is applied to the input of the sixteen advancing counter and to the flip-flop 71 as a reset signal, when the rotated condition of the stepping motor is detected, by the flip-flop 68 and the AND gates 69a, 69b, while it is applied to the counter 70 as a clock signal when the non-rotated condition is detected. As a result, the flip-flop 71 is set by the carry signal of the counter 70 only when more than sixteen correction drives have taken place in succession. However, if there is no correction driving even if only once afterwards, it is reset although it was set once.

Now, the setting of the flip-flop 71 will enable the selection gate 72 to select the signal F. Since the signal F is a signal having a period of two seconds as shown in FIG. 13 by reference character f, the timing of the correction driving changes every one second, so that the voltage having a wave shape of $g_2$ as shown in FIG.

13 is applied to across the coil 14. The pointer movement operation at this time is performed every two seconds so that a warning is given to the user of the watch.

As described in the foregoing, in the electronic watch according to the present invention a so-called self-diagnosis function can be realized by utilizing a direct detection method of detecting the rotation or the non-rotation condition of the stepping motor, thus giving effective information to the user of the watch.

It is apparent that the principle of operation of the stepping motor rotation detecting device as well as the configuration of the stepping motor and construction and form of a circuit thereof by no means restrict to the spirit of the present invention.

We claim:

1. An electronic timepiece, comprising:

an oscillator circuit for generating an oscillating time standard signal;

pulse generating means for dividing the time standard signal and for generating output pulse signals comprised of pulses having different pulse widths;

a stepping motor comprised of a stator, a rotor and a coil;

drive circuit means responsive to pulse signals from said pulse generating means for periodically applying electrical driving pulses to said motor coil to rotate said rotor at a normal periodic rate and responsive to a control signal for energizing said motor coil to rotate said rotor at a rate different from the normal periodic rate;

a gear train driven by said stepping motor;

a time display having a pointer driven by said gear train;

detecting means for detecting whether or not said rotor had rotated in response to the output of said drive circuit and for applying an output signal as a control signal to said drive circuit means; and a battery serving as a power source;

the movement of said pointer being performed at a rate different from said normal periodic rate to indicate that the electrical driving pulse was ineffective to rotate said rotor when said detecting means detects that the driving power required in the rotation of said rotor is over a predetermined level.

2. In an electronic timepiece according to claim 1, wherein said stepping motor coil exhibits a current verses time characteristic having a high rise time when said rotor is not in a position to rotate and having a low rise time when said rotor is in a position to rotate;

and said detecting means is comprised of a resistor, switching means controllable for switching said resistor between a condition wherein a coil current flows through said resistor and a condition wherein no coil current flows through said resistor, means for applying a detecting pulse to said motor coil after a driving pulse has been applied to said motor coil and for controlling said switching means to switch said resistor to the condition wherein the coil current which flows in response to the detecting pulse also flows through said resistor, and means for generating the control signal if the coil current which flows through said resistor exhibits the current verses time characteristic having the low rise time.

3. In an electronic timepiece, the combination comprising:

an oscillator circuit for generating an oscillating time standard signal;

pulse generating means for dividing the time standard signal and for generating output pulse signals comprised of pulses having different pulse widths;

a stepping motor comprised of a stator, a rotor and a coil;

drive circuit means responsive to pulse signals from said pulse generating means for periodically applying electrical driving pulses to said motor coil to rotate said rotor at a normal periodic rate and responsive to a control signal for energizing said motor coil to rotate said rotor at a rate different from the normal periodic rate; and detecting means for detecting whether or not said rotor had rotated in response to a driving pulse and for applying a control signal to said drive circuit means to control said drive circuit means to energize said motor coil and rotate said rotor at a rate different from said normal periodic rate to indicate that the electrical driving pulse was ineffective to rotate said rotor.

4. In an electronic timepiece according to claim 3, wherein said stepping motor coil exhibits a current verses time characteristic having a high rise time when said rotor is not in a position to rotate and having a low rise time when said rotor is in a position to rotate;

and said detecting means is comprised of a resistor, switching means controllable for switching said resistor between a condition wherein a coil current flows through said resistor and a condition wherein no coil current flows through said resistor, means for applying a detecting pulse to said motor coil after a driving pulse has been applied to said motor coil and for controlling said switching means to switch said resistor to the condition wherein the coil current which flows in response to the detecting pulse also flows through said resistor, and means for generating the control signal if the coil current which flows through said resistor exhibits the current verses time characteristic having the low rise time.

5. In an electronic timepiece according to claims 3, 4, 1 or 2, wherein said drive circuit means is responsive to pulse signals from said pulse generating means for periodically applying electrical driving pulses to said motor coil to rotate said rotor at a normal periodic rate, is responsive to a first control signal for applying an electrical correction pulse having a pulse width greater than said driving pulses to said motor coil to rotate said rotor at a normal periodic rate, and is responsive to a second control signal for applying electrical correction pulses having respective pulse widths greater than said driving pulses to said motor coil to rotate said rotor at a rate different than the normal periodic rate; and wherein said detecting means is effective for detecting whether or not said rotor had rotated in response to a driving pulse and for applying the first control signal to said drive circuit means to control said drive circuit means to energize said motor coil with the correcting pulses and rotate said rotor at the normal periodic rate after a drive pulse was ineffective to rotate said rotor, and said detecting means is effective for applying the second control signal to said drive circuit means after the first control signal has been applied to said drive circuit means a predetermined consecutive number of times to rotate said rotor at a rate different from said normal periodic rate to indicate that the electrical driving pulses are ineffective to rotate said rotor.

* * * * *